US006145955A

United States Patent [19]

Yamaguchi

[11] Patent Number: 6,145,955

[45] Date of Patent: Nov. 14, 2000

[54] INK-JET RECORDING APPARATUS

[75] Inventor: Shuichi Yamaguchi, Nagano, Japan

[73] Assignee: Seiko Epson Corporation, Tokyo, Japan

[21] Appl. No.: 08/972,841

[22] Filed: Nov. 18, 1997

[30] Foreign Application Priority Data

Nov. 18, 1996 [JP] Japan ..... 8-322346

[51] Int. Cl.[7] ..... B41J 2/165

[52] U.S. Cl. ..... 347/29

[58] Field of Search ..... 347/5, 22, 23, 347/29, 30, 37

[56] References Cited

FOREIGN PATENT DOCUMENTS 0 585 923 3/1994 European Pat. Off. ..... B41J 2/165
0 599 503 6/1994 European Pat. Off. ..... B41J 2/165

OTHER PUBLICATIONS

Patent Abstracts of Japan vol. 096, No. 009, Sep. 30, 1996 & JP 08 118674 A (Canon Inc) May 14, 1996 *Abstract.

Patent Abstracts of Japan vol. 014 No. 132 (M–0948) Mar. 13, 1990 & JP 02 002014 A (Canon Inc) Jan. 8, 1990 *Abstract.

Patent Abstracts of Japan vol. 008 No. 037 (M–277) Feb. 17, 1984 & JP 58 194554 A (Canon KK) Nov. 12, 1983 *Abstract.

Patent Abstracts of Japan vol. 018, No. 554 (M–1691) Oct. 21, 1994 & JP 06 198897 A (Canon Inc) Jul. 19, 1994 *Abstract.

Patent Abstracts of Japan vol. 095, No. 008, Sep. 29, 1995 & JP 07 125223 A (NEC Corp) May 16, 1995 *Abstract.

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

An ink-jet recording apparatus is provided with a recording head for discharging ink drops and disposed on a carriage which makes a reciprocating motion in the width direction of a recording medium, a cap for sealing the recording head in a non-printing area and receiving the ink drops discharged for the maintenance of the recording head during a printing operation, an ink receiving member which is capable of moving within a moving locus range of the recording head and disposed in the non-printing area situated opposite to the cap side. As the ink receiving member is positioned close to the side end of recording paper in agreement with its width, the distance between the ink receiving member and the side end of the recording paper is shortened.

9 Claims, 8 Drawing Sheets

INK-JET RECORDING APPARATUS

BACKGROUND OF THE INVENTION

1. Field of the Invention

The present invention relates to an ink-jet recording apparatus for printing a pattern by ejecting ink drops from nozzle ports onto a recording medium.

2. Description of the Related Art

As a typical ink-jet recording apparatus employs a recording head so constructed as to eject ink drops from nozzle ports by pressurizing ink in a pressure generating chamber by means of a piezo-electric element and a heat generating element, the apparatus needs means for preventing printing-quality deterioration due to the drying of ink near the nozzle ports and the adhesion of dust thereto.

One known method that has been adopted to solve the problem above is to move the recording head to a capping unit installed in a standby position each time the printing operation continues for a predetermined length of time, for example, 20 seconds, and a so-called flushing operation is caused to be performed in order to discharge ink drops from the whole nozzle port, so that the nozzle ports are prevented from being clogged with viscous ink sticking thereto.

On arrival of the timing of the flushing operation on a side opposite to the side where the capping unit is disposed, however, the flushing operation has to be performed by interrupting the printing operation in order to move the recording head to the capping position. The problem is that the time required for idle traveling is wasteful and this results in lowering the printing speed.

In order to solve this problem, the ink-jet recording apparatus has been proposed such that an ink receptacle is disposed on both sides of recording paper and, on arrival of flushing timing, a recording head is moved to one of the ink receptacles which is situated closer thereto so that the recording head undergoes flushing.

With the aforementioned arrangement, it is possible to improve the printing speed because the time required for the idle travel of the recording head is reduced as long as the flushing operation is concerned. When, however, recording paper particularly narrow in width is used for printing, there develops a problem in that the printing speed is rather low for its size as the idle travel distance is extended since the ink receptacles are positioned in synchronization with the maximum recordable width of recording paper.

SUMMARY OF THE INVENTION

An object of the present invention made in view of the foregoing problems is to provide an ink-jet recording apparatus designed to improve printing throughput by adjusting an ink discharging position in proportion to the width of recording paper so as to shorten the idle travel distance of a recording head when a flushing operation is performed.

In order to solve the foregoing problems, an ink-jet recording apparatus according to the present invention comprises a recording head for discharging ink drops and disposed on a carriage which makes a reciprocating motion in the width direction of a recording medium, and a cap for sealing the recording head in a non-printing area and receiving the ink drops discharged for the maintenance of the recording head during a printing operation, wherein an ink receiving member capable of moving within a moving locus range of the recording head is provided in the non-printing area situated opposite to the cap side.

As the ink receiving member is positioned close to the side end of recording paper in agreement with its width, the distance between the ink receiving member and the side end of the recording paper is shortened with the effect of reducing the idle travel time of the ink-jet recording head.

DETAILED DESCRIPTION OF THE PREFERRED EMBODIMENTS

Referring the accompanying drawings, there is given a detailed description of embodiments of the present invention.

Figure 1:
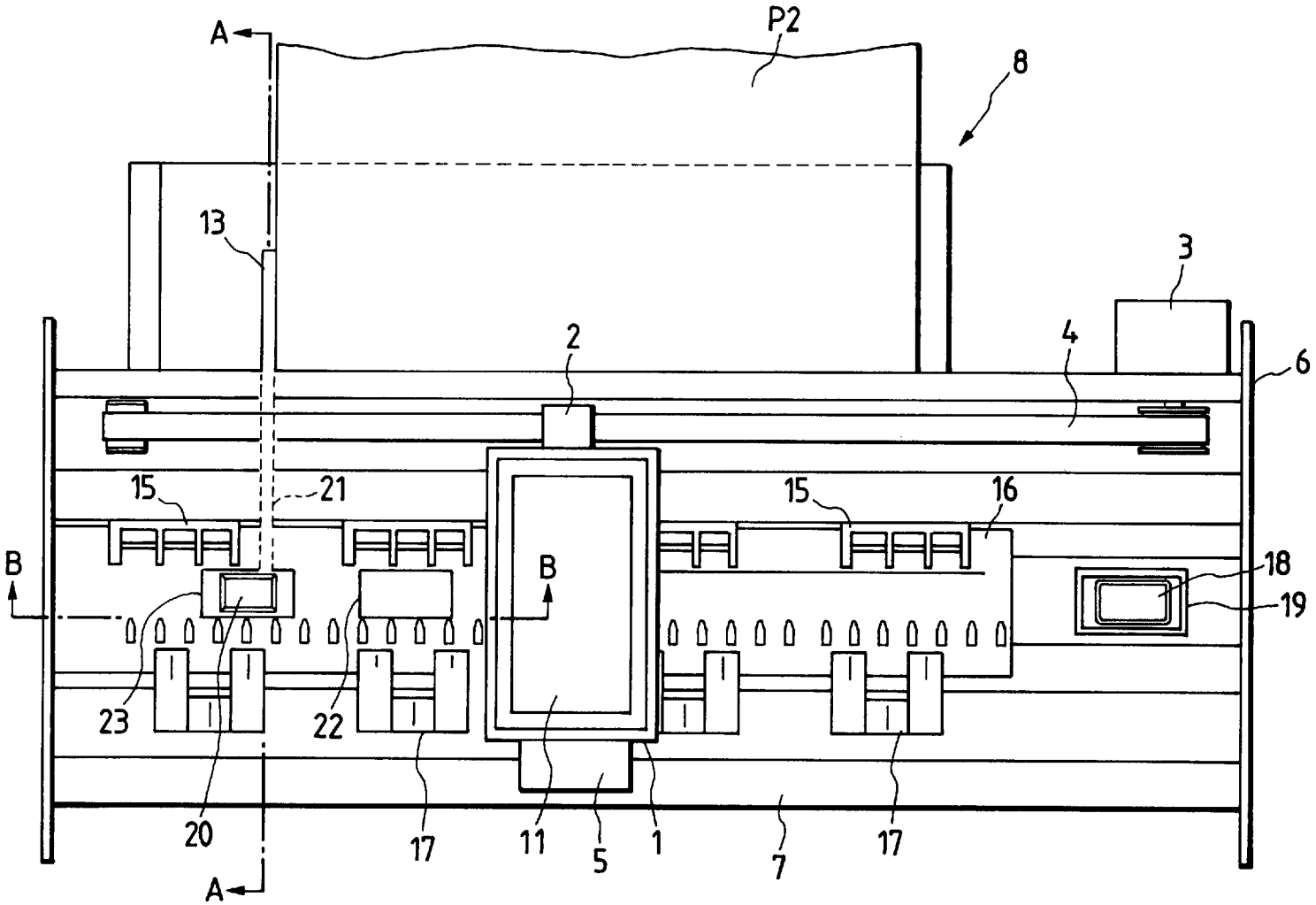
FIG. 1 is a plan view of an ink-jet recording apparatus embodying the present invention.
Figure 2A:
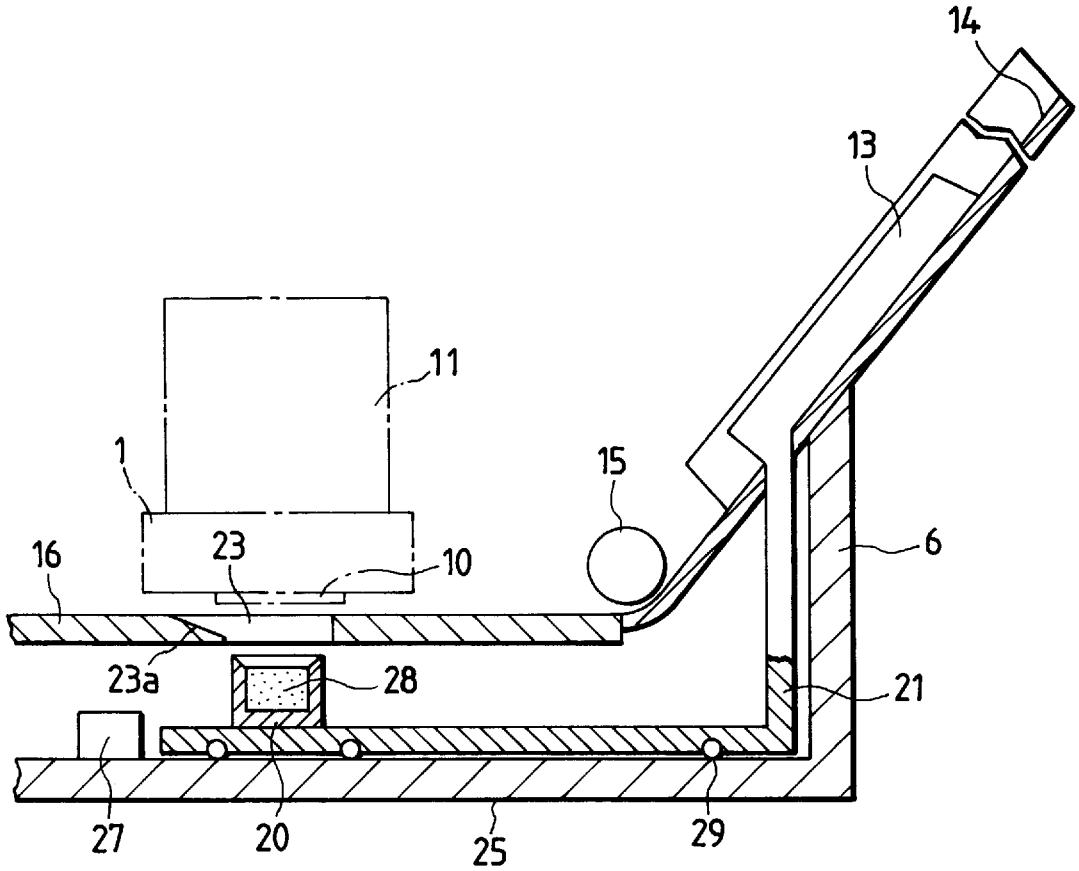
FIGS. 2(*a* ) and 2(*b*) are sectional views taken along lines A—A and B—B showing the construction of FIG. 1, respectively.
Figure 2B:
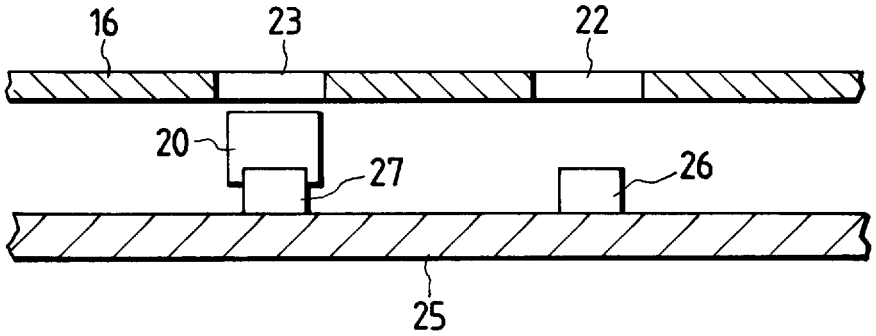

FIG. 1 is a plan view of an ink-jet recording apparatus embodying the present invention, FIG. 2(*a*) is a sectional view taken along line A—A of FIG. 1, and FIG. 2(*b*) is a sectional view taken along line B—B of FIG. 1, wherein reference numeral 1 denotes a carriage whose one side is coupled via a coupler 2 to a timing belt 4 which is driven by a motor 3 and the other side is supported by the guide member 7 of a casing 6 via a slider 5 in such a way that it is capable of a reciprocating motion in the width direction of a paper holder 8.

An ink-jet recording head 10 for discharging ink drops in response to a printing signal is secured to the underside of the carriage 1, and an ink cartridge 11 is mounted on the surface of the ink-jet recording head 10.

One side (the right-end side in FIG. 1) of the paper holder 8 is defined as a reference position, whereas the other end thereof (the left-end side therein) is provided with a paper width adjusting lever 13 for precisely setting sheets of paper different in size such as postcards, those of B5, A4 and the like in such a way that the paper width adjusting lever 13 is movable with respect to a paper supporting plate 14. At the lower end of the paper supporting plate 14, paper feeding rollers 15, 15 for conveying recording paper to a printing area are installed, whereby sheets of recording paper P1, P2 are fed via a platen 16 to paper discharging rollers 17.

A capping unit 19 having a cap member 18 for sealing the ink-jet recording head 10 is provided in the home position outside the printing area.

Further, reference numeral 20 denotes an ink receiving member 20 featuring the present invention, which ink receiving member 20 accommodates an ink absorbing member 28 and is connected to an arm 21 extending from the paper width adjusting lever 13 whereby to move in opposition to the moving locus of the ink-jet recording head 10 by following the movement of the paper width adjusting lever 13.

On the other hand, the platen 16 is provided with windows 22, 23 capable of exposing the surface of the ink receiving member 20 in a position opposite to which the ink receiving member 20 looks when the paper width adjusting lever 13 is moved in synchronization with the paper width. Incidentally, either window 22 or 23 corresponding to the width of recording paper other than the maximum width of what is to be printed, that is, the window 23 according to this embodiment of the present invention, is formed with a surface 23a which is tilted toward the inflowing side.

Further, a base 25 is provided with detectors 26, 27 for detecting the position of the ink receiving member in order to output signals, depending on the condition in which the ink receiving member 20 is brought into contact with or situated opposite to one of the windows 22, 23. Reference numeral 29 denotes a roller to guide the arm 21 along the surface of the base 25.

Figure 3:
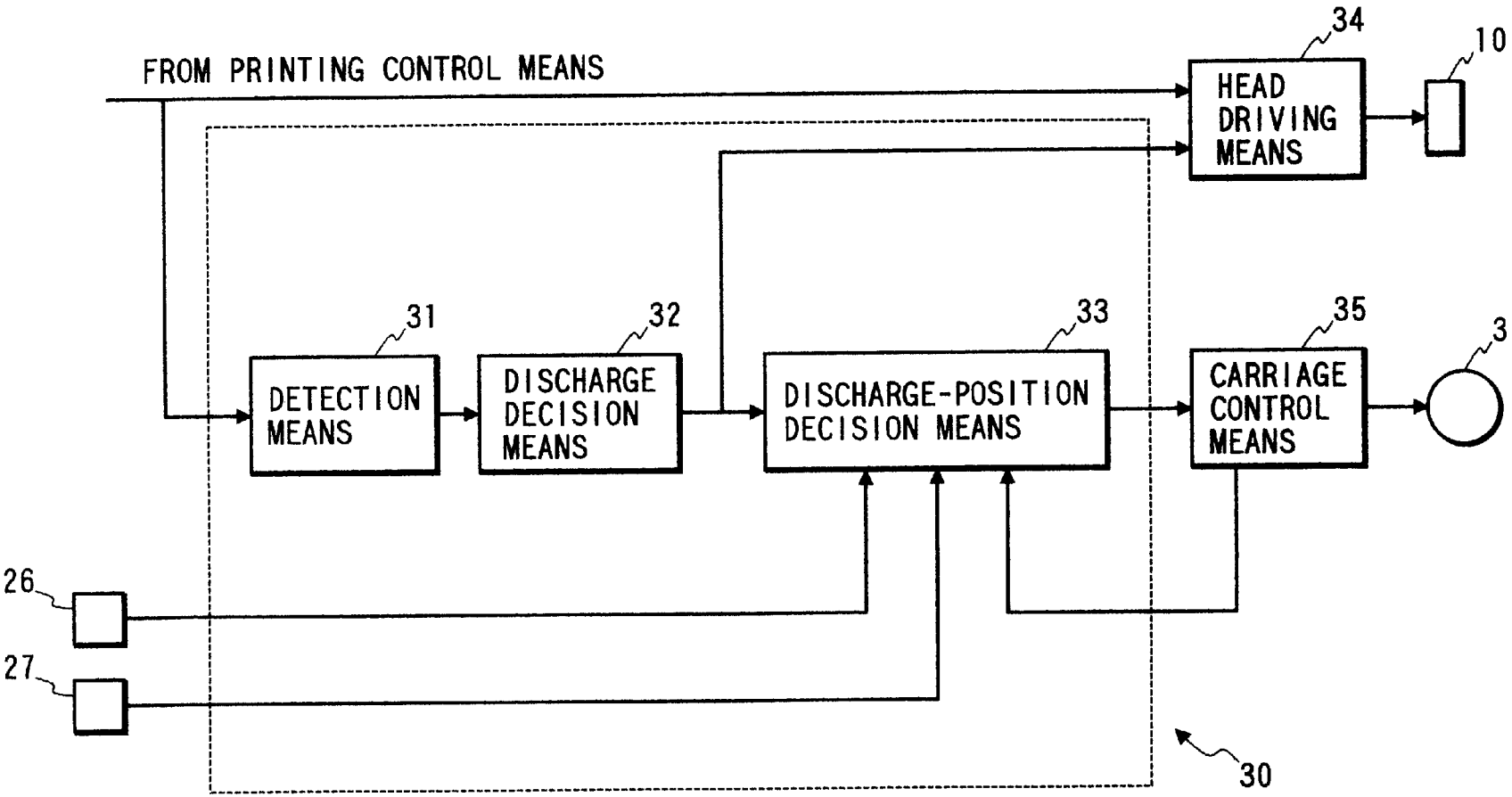
FIG. 3 is a block diagram of a flushing control unit embodying the present invention.

FIG. 3 shows an example of a flushing control unit comprising a detection means 31 for detecting printing quantity by computing printing time on receiving a signal from a printing control means (not shown) or computing the number of printing lines; a discharge decision means 32 for deciding flushing timing on the basis of the printing quantity; and a discharge-position decision means 33 for selecting the cap member 18 or the ink receiving member 20 on the basis of the position of the carriage 1 at the flushing timing and on the basis of the position of the ink receiving member 20 according to the signals received from the detectors 26, 27. The flushing control unit also operates to send signals to a head driving means 34 for causing ink to be discharged from the ink-jet recording head 10 according to the printing signal and to a carriage control means 35 for controlling the movement of the carriage 1, whereby the ink is discharged into the cap member 18 or the ink receiving member 20 positioned close to and outside the recording paper.

Figure 4A:
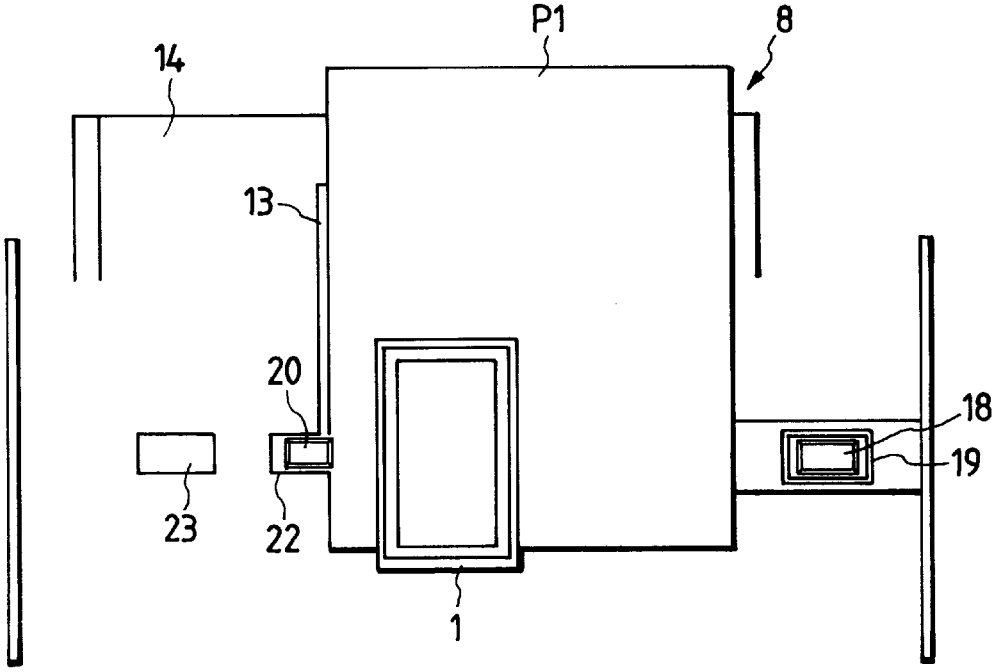
FIGS. 4(*a*) and 4(*b*) show the operations of the apparatus above, respectively.
Figure 4B:
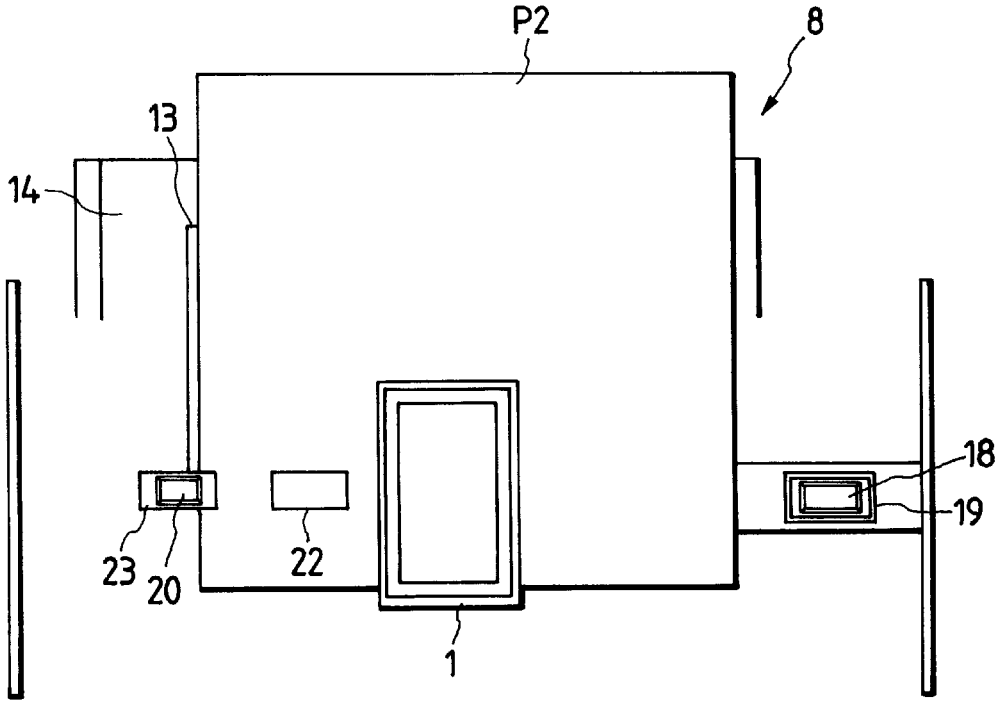

When recording paper P1 of, for example, B5 is set to the reference position of the paper holder 8 and when the recording paper P1 is brought into contact with the paper width adjusting lever 13 as shown in FIG. 4(*a*), the ink receiving member 20 is set outside the recording paper P1 of B5 as close as possible thereto and exposed to the window 22 because the movement of the ink receiving member 20 is interlocked with that of the paper width adjusting lever 13.

When the printing operation is started in this state, a signal is output from the discharge decision means 32 whenever printing time exceeds the length of time T predetermined by the detection means 31 for detecting printing quantity, for example, 20 seconds or at a point of time the printed lines exceeds 10. The discharge-position decision means 33 selects what is positioned closer to the ink-jet recording head 10 out of the capping unit 19 or the ink receiving member 20, for example, the ink receiving member 20 facing the window 22 according to the present position of the ink-jet recording head 10, and makes the ink-jet recording head 10 move to the ink receiving member 20, thus causing the ink-jet recording head 10 to perform the flushing operation, whereby viscous ink in the proximity of nozzle ports is discharged into the ink receiving member 20.

When the flushing operation is finished, the printing operation is restarted and the ink receiving means positioned closer to the ink-jet recording head 10, for example, capping unit 19 is selected as in the aforementioned case at the stage where the printing quantity has reached the predetermined one, and the ink-jet recording head 10 is moved up to a position where it faces the capping unit 19 so as to discharge ink toward the cap member 18.

Then the capping unit 19 or the ink receiving member 20 as the ink receiving means, namely, what is positioned closer to the ink-jet recording head 10 is moved to the ink-jet recording head 10 each time the printing quantity reached the predetermined one, so that the flushing operation is performed.

Since the ink receiving member 20 is positioned close to recording paper P1 even in the case of narrow recording paper P1, the travel distance of the ink-jet recording head 10 is shortened as much as possible in order to improve the printing throughput when the flushing operation is performed on the non-capping area side.

Subsequently, recording paper P1 of B5 that has been loaded is taken out and recording paper P2 of A4 is loaded in order to change the recording paper. When the paper width adjusting lever 13 is then adjusted to the width of the paper P2, the ink receiving member 20 is moved to the window 23 and exposed as shown in FIG. 4(*b*).

When the paper quantity reaches the predetermined one, the discharge-position decision means 33 makes the ink-jet recording head 10 move to what is positioned closer to the ink-jet recording head 10 out of the capping unit 19 or the ink receiving member 20, for example, the ink receiving member 20 facing the window 23 according to the present position of the ink-jet recording head 10, thus causing the ink-jet recording head 10 to perform the flushing operation.

When the flushing operation is finished, the printing operation is restarted and as the printing operation proceeds, the recording paper P2 is fed. However, the paper jamming is never occurred because the recording paper P2 slides along a surface 22*a* which is tilted toward the inflowing side of the recording paper P2 and moves onto the downstream side.

Further, since the ink receiving member 20 is situated outside the printing area of the recording paper P2 subjected to the printing operation and also separated by the platen 16 from the recording paper P2, the back of the recording paper P2 is never stained by the ink receiving member 20.

Thereafter, the ink-jet recording head 10 is moved to what is positioned closer to the ink-jet recording head 10 out of the capping unit 19 or the ink receiving member 20 facing the window 23, as the ink receiving means each time the printing operation is performed by the predetermined quantity.

When characters are printed on a recording medium whose recording width is extremely small such as a postcard, on the other hand, because the ink receiving member 20 face any of the detectors 26, 27, the discharge-position decision means 33 subjects the capping unit 19 to the flushing operation, irrespective of the position of the ink-jet recording head 10, on detecting a state in which no signal is output from any one of the detectors 26, 27, whereby the printing throughput is made improvable by simplifying the control of movement of the carriage.

Figure 5:
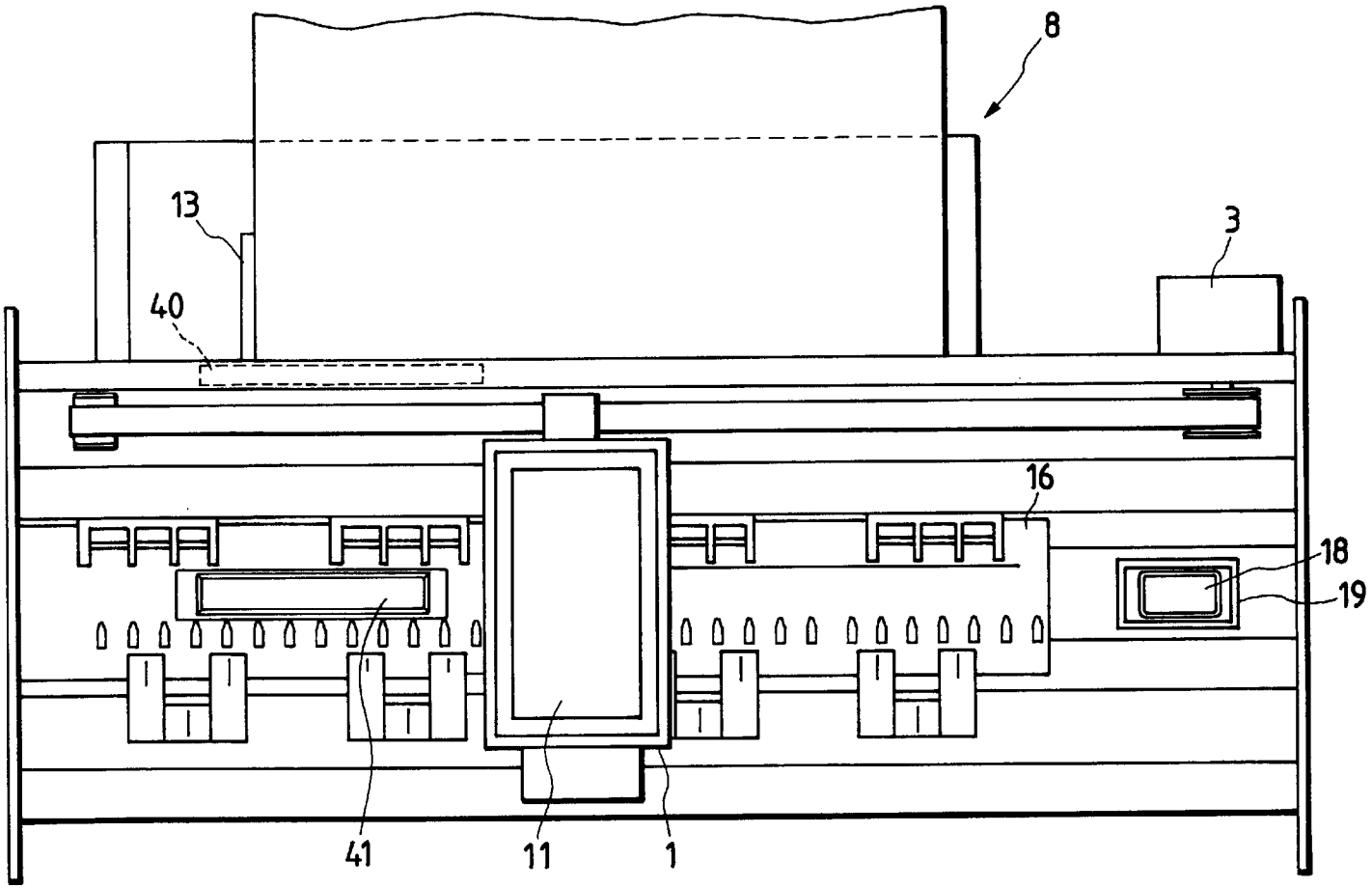
FIG. 5 is a plan view of another ink-jet recording apparatus embodying the present invention.

It has been arranged that the flushing position on the non-capping side is determined by making the detectors 26, 27 detect the position of the ink receiving member 20 whose movement is interlocked with that of the paper width adjusting lever 13 of the paper holder 8 according to above-described embodiment of the present invention. However, the ink-jet recording apparatus may be provided with, as shown in FIG. 5, a lever position detector 40 for detecting the position of the paper width adjusting lever 13 of the paper holder 8, and an ink receiving member 41 capable of covering the moving range of the ink-jet recording head 10 in the non-capping area so as to decide an ink discharging position in the non-capping area by deciding the width of recording paper according to a signal from the lever position detector 40 or recording paper size data from a printing-paper selecting switch 42 installed on the panel surface of a host computer or a recording apparatus body (not shown).

Figure 6:
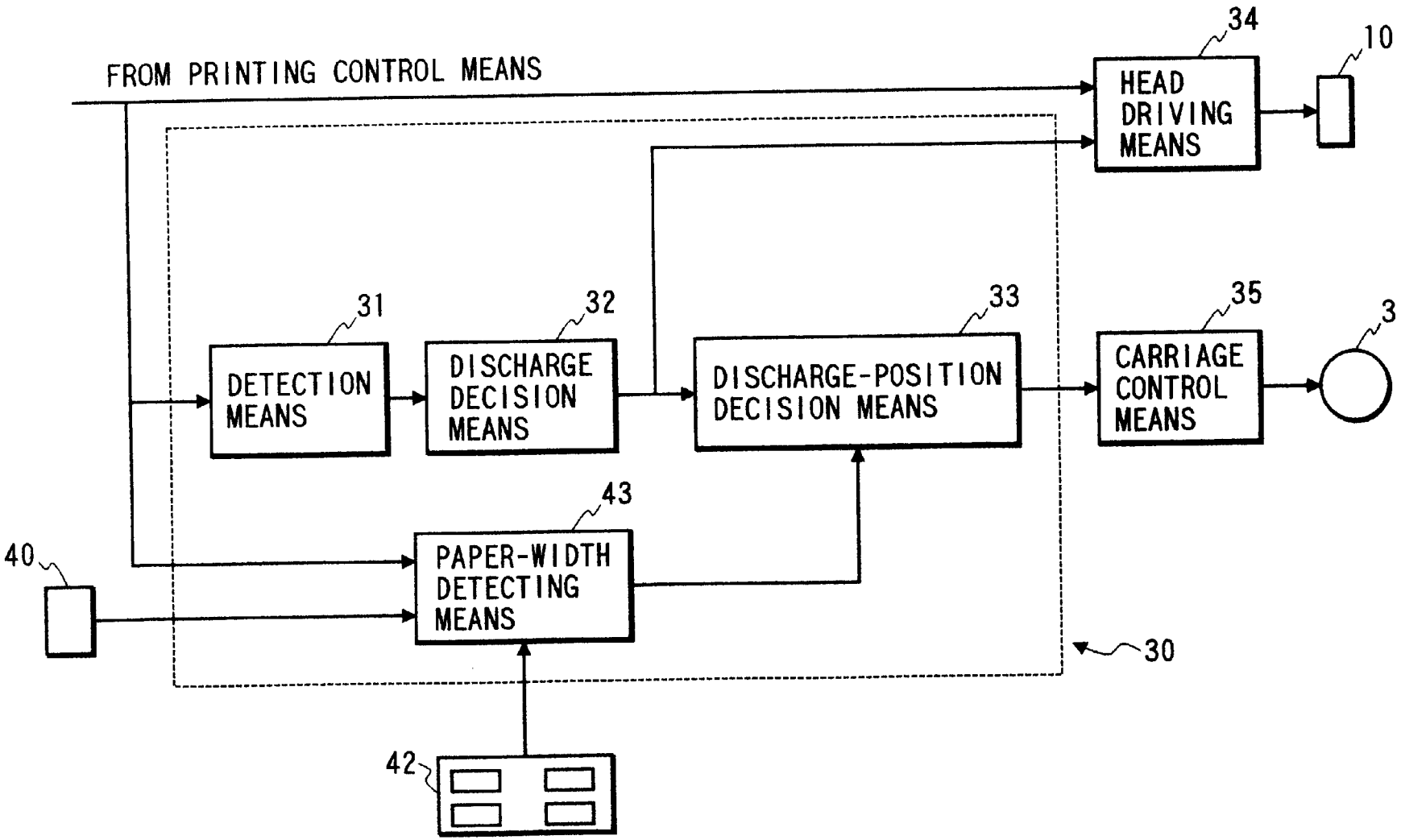
FIG. 6 is a block diagram of a flushing control unit fit for use in the above recording apparatus according to the present invention.

More specifically, as shown in FIG. 6, the flushing operation is made performable in a position closer to recording paper on the non-capping area side by providing a paper-width detecting means 43 for detecting the width of the recording paper and making the paper-width detecting means 43 input a signal to the discharge-position decision means 33 according to the signal from the lever position detector 40, data on a printing format from the host computer or the signal from the printing-paper selecting switch 42 of the recording apparatus body.

Figure 7:
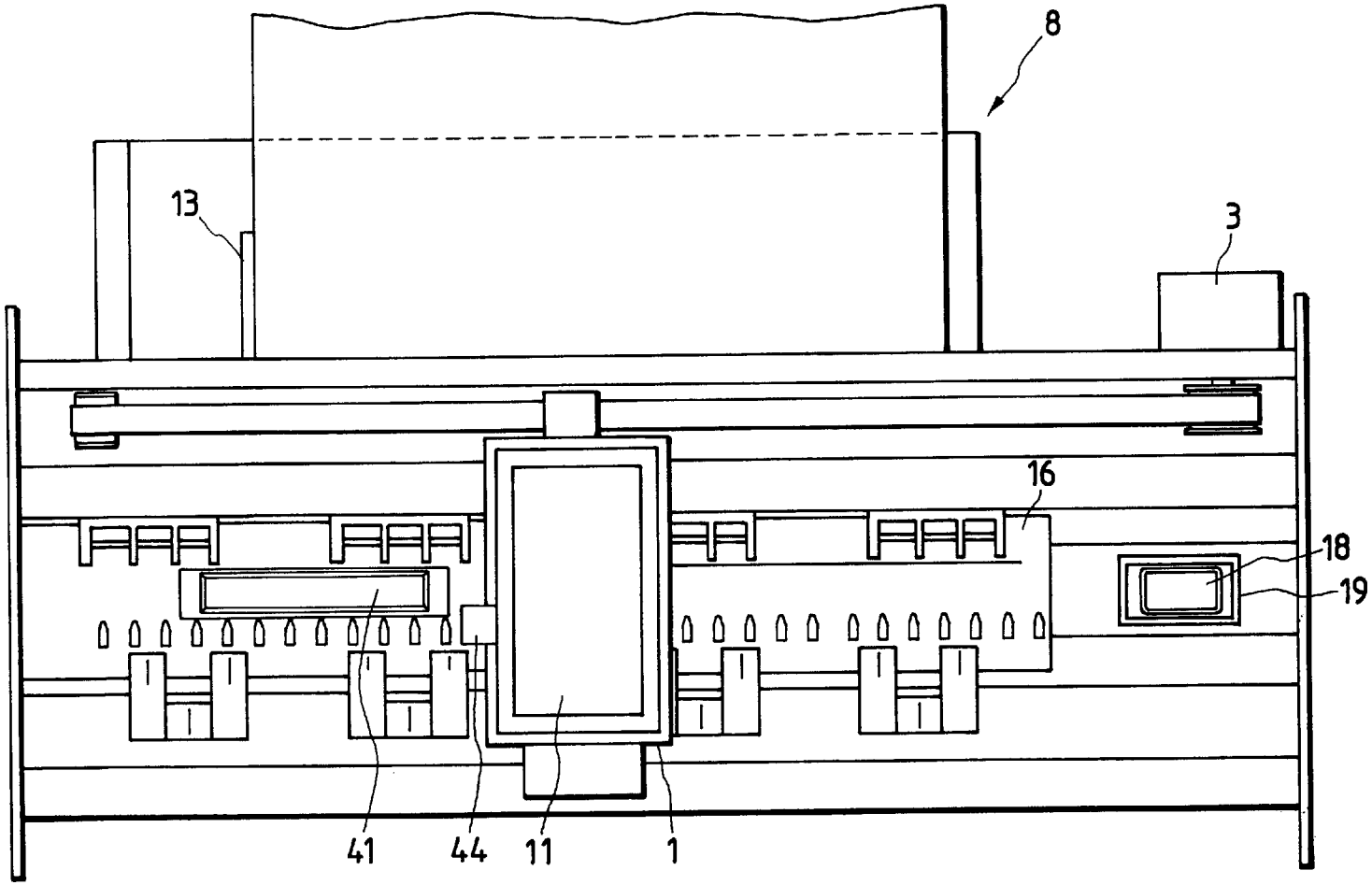
FIG. 7 is a plan view of still another ink-jet recording apparatus embodying the present invention.
Figure 8:
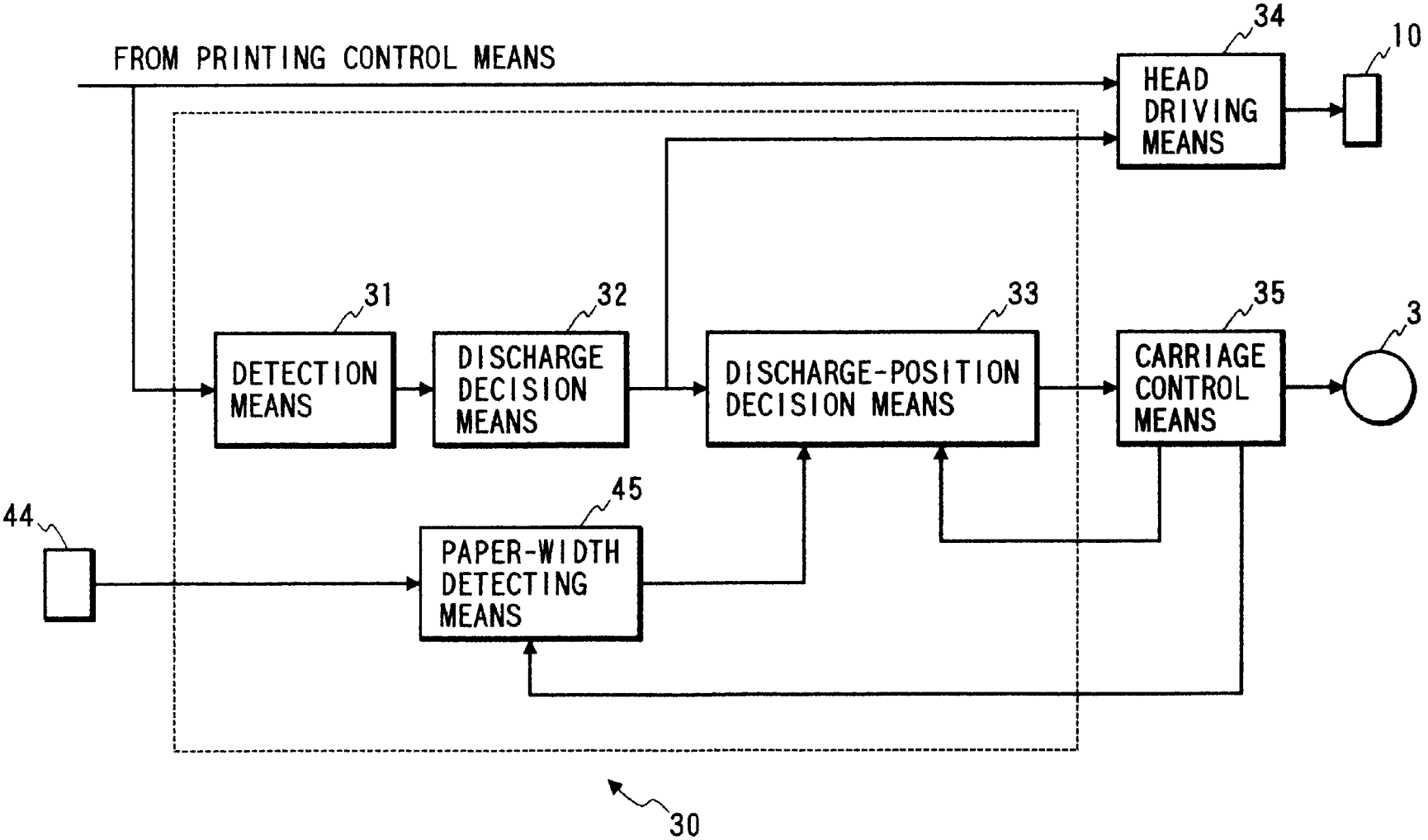
FIG. 8 is a block diagram of a flushing control unit fit for use in the above recording apparatus according to the present invention.

FIG. 7 shows another embodiment of the present invention, wherein the carriage 1 is provided with a paper-end detector 44 for detecting the end portion on the non-capping side of recording paper on one hand, and a flushing control unit 30 is provided with a paper-width detecting means 45 for detecting paper width according to the moving distance of the carriage 1 from the reference position at a point of time a signal is output from the paper-end detector 44 on the other as shown in FIG. 8, whereby a signal from the paper-width detecting means 45 is input to the discharge-position decision means 33.

According to this embodiment of the present invention, the position adjustment of the ink receiving member can be dispensed with, so that printing preparation work is simplified.

In the case of a recording apparatus so arranged that recording paper of predetermined size is accommodated in a cassette in order to change the paper size by replacing the cassette, the determination of the flushing position on the non-capping area side can be based on the decision of paper width made by detecting the kind of such a cassette.

As set forth above, the ink-jet recording apparatus according to the present invention comprises the recording head for sending jets of ink drops to the carriage which makes a reciprocating motion in the width direction of the recording medium, and the cap for sealing the recording head in a non-printing area and receiving the ink drops discharged for the maintenance of the recording head during the printing operation, wherein the ink receiving member capable of moving within the moving locus range of the recording head is provided in the non-printing area situated opposite to the cap side. Therefore, the distance between the ink receiving member and the side end of recording paper can be set to a minimum value, irrespective of the size of the recording paper, and besides the throughput can also be improved by shortening the idle travel distance of the ink-jet recording head during the operation of recovering ink discharge capability.

What is claimed is:

1. An ink-jet recording apparatus comprising:

a base;

a recording head, for ejecting an ink, disposed on the base for movement in a width direction of a recording medium in a first non-printing area, a printing area, and a second non-printing area;

a cap, for receiving the ink from the recording head, disposed on the base in the first non-printing area; and an ink receiving member, for receiving the ink from the recording head, disposed on the base in the second non-printing area;

wherein the ink receiving member is disposed on the base for movement in the width direction of the recording medium.

2. The ink-jet recording apparatus according to claim 1, further comprising:

control means, for determining a shorter distance among the distances between (1) the recording head and the cap, and (2) the recording head and the ink receiving member, and for moving the recording head to the cap or the ink receiving member that is spaced apart from the recording head the shorter distance.

3. The ink-jet recording apparatus according to claim 2, wherein, when the recording medium has a width that is less than a predetermined value, the control means moves the recording head to the cap irrespective of the shorter distance.

4. The ink-jet recording apparatus according to claim 1, further comprising:

paper width adjusting lever disposed on the base for movement in the width direction of the recording medium;

wherein the paper width adjusting lever and the ink receiving member are fixed together.

5. The ink-jet recording apparatus according to claim 1, further comprising:

a platen, for supporting the recording medium in the printing area, disposed on the base, the platen interposing between the ink receiving member and the recording head:

wherein the platen is provided with a plurality of windows, such that, when the recording head, one of the windows, and the ink receiving member are aligned, the ink ejected from the recording head passes through the platen and into the ink receiving member.

6. An ink-jet recording apparatus comprising:

a base;

a recording head, for ejecting ink, disposed on the base for movement in a width direction of a recording medium in a first non-printing area, a printing area, and a second non-printing area;

a cap, for receiving the ink from the recording head, disposed on the base in the first non-printing area;

an ink receiving member, for receiving the ink from the recording head, disposed on the base in the second non-printing area;

recording-medium-width decision means for detecting a width of the recording medium; and control means, coupled to the recording-medium-width decision means, for causing ink to discharge onto the ink receiving member at a position that is based on the detected width of the recording medium.

7. The ink-jet recording apparatus according to claim 6, further comprising:

one of (1) a host computer coupled to the ink-jet recording apparatus and (2) a paper size selecting switch provided on the base that generates a signal based on a size of the recording medium:

wherein the recording medium-width decision means detects the width of the recording medium according to the signal.

8. The ink-jet recording apparatus according to claim 6, further comprising:

a recording medium loading mechanism provided on the base, and having a lever that is positionable in the width direction of the recording medium;

wherein the recording-medium-width decision means detects a position of the lever.

9. The ink-jet recording apparatus according to claim 6, wherein, when the detected width of the recording medium is less than a predetermined value, the control means causes the ink to discharge into the cap, irrespective of a position of the ink-jet recording head.

* * * * *